US012042051B1

(12) United States Patent
Kalies

(10) Patent No.: US 12,042,051 B1
(45) Date of Patent: Jul. 23, 2024

(54) PILLOW POSITION MAINTAINER

(71) Applicant: Kevin Carl Kalies, Pine River, WI (US)

(72) Inventor: Kevin Carl Kalies, Pine River, WI (US)

( * ) Notice: Subject to any disclaimer, the term of this patent is extended or adjusted under 35 U.S.C. 154(b) by 153 days.

(21) Appl. No.: 17/740,112

(22) Filed: May 9, 2022

Related U.S. Application Data

(60) Provisional application No. 63/188,152, filed on May 13, 2021.

(51) Int. Cl.
*A47C 21/02* (2006.01)

(52) U.S. Cl.
CPC ..... *A47C 21/026* (2013.01)

(58) Field of Classification Search
USPC ..... 160/330
See application file for complete search history.

(56) References Cited

U.S. PATENT DOCUMENTS

| | | | | |
|---|---|---|---|---|
| 468,257 A | | 2/1892 | Paige | |
| 1,053,105 A | * | 2/1913 | Growan | A47C 20/027 5/492 |
| 1,361,605 A | | 12/1920 | Morrill | |
| 1,365,169 A | | 1/1921 | Goldberg | |
| 3,141,221 A | | 7/1964 | Faulls, Jr. | |
| 3,346,892 A | | 10/1967 | Priest | |
| 3,506,988 A | | 4/1970 | Saddoris | |
| 4,345,346 A | | 8/1982 | Holtz | |
| 5,147,110 A | * | 9/1992 | Syers | B60N 2/882 297/220 |
| 6,126,237 A | * | 10/2000 | Ritterhouse | A47C 7/383 297/410 |
| 6,438,805 B1 | | 8/2002 | Goss et al. | |

(Continued)

FOREIGN PATENT DOCUMENTS

| | | | |
|---|---|---|---|
| GB | 2477950 | | 8/2011 |
| JP | 2002119384 A | * | 4/2002 |

(Continued)

OTHER PUBLICATIONS

Tarp Tie Down Company, The Official Site of the EZ Grabbit Tarp Tie Down, as viewed at https://www.tarptiedown.com/?view05#/view05 on Mar. 24, 2021, 1 page.

(Continued)

*Primary Examiner* — Adam C Ortiz
(74) *Attorney, Agent, or Firm* — Brannen Law Office, LLC

(57) ABSTRACT

A pillow position maintainer is provided. A harness is provided to affix to an object such as a chair or mattress. The harness has a loop and can have two adjustment straps. A hanger is provided with a shell and core. It also can have two fastener straps. The fastener strap(s) is removably connectable to the adjustment strap(s) and are connected to the shell. The position of the shell is adjustable with respect to the object via adjustment of the adjustment straps. The shell has a channel with a slot and a cavity. The channel is open to both ends of the shell. The inside of the cavity can have surfaces that are flat, such as a hexagon. The core is a compressible core. The core can be positioned inside a pillow case, and then be inserted into the cavity with the pillow case passing through the slot.

20 Claims, 17 Drawing Sheets

(56) References Cited

U.S. PATENT DOCUMENTS

| | | | | |
|---|---|---|---|---|
| 6,666,426 | B1 | 12/2003 | Taylor | |
| 7,086,105 | B1 | 8/2006 | Gottlieb | |
| 7,503,696 | B2 | 3/2009 | Ha et al. | |
| 8,607,382 | B1 | 12/2013 | Cohron, III | |
| 2008/0164734 | A1* | 7/2008 | Nile | A47C 7/425 297/230.13 |
| 2012/0087603 | A1 | 4/2012 | Chen et al. | |
| 2012/0102890 | A1 | 5/2012 | Fily et al. | |

FOREIGN PATENT DOCUMENTS

| | | | | |
|---|---|---|---|---|
| JP | 3108141 U | * | 10/2004 | |
| JP | 2006204643 A | * | 8/2006 | A47C 21/026 |
| JP | 3175807 U | * | 5/2012 | |

OTHER PUBLICATIONS

Gripstic, the Gripstic is the best bag sealer made! Better than chip clips!, as viewed at https://gripstic.com on Mar. 26, 2021, 8 pages.

* cited by examiner

PILLOW POSITION MAINTAINER

This United States utility patent application claims priority on and the benefit of provisional application 63/188,152 filed May 13, 2021, the entire contents of which are hereby incorporated herein by reference.

BACKGROUND OF THE INVENTION

1. Field of the Invention

The present invention relates to a pillow position maintainer, and in particular to a pillow position maintainer having a harness and a hanger with a shell and a core.

2. Description of the Related Art

The prevalence of pillow use is unquestioned. People use them many places, such as in bed or in a chair. It is desirable to be able to position the pillow to an intended location with respect to the chair, or mattress, for example. There are other situations where positioning a pillow is desired, but for sake of brevity, it will be discussed with chairs and mattresses.

People commonly use pillows with recliners or with articulating beds to aid in comfort. Often times, the pillow is used by the elderly or people recovering from illness and/or injury. Yet, during use, the pillow often slides down the chair back or mattress resulting in discomfort and/or improper support. For these people, it is challenging to reposition a pillow that has slid to bar down the chair back or head end of the mattress. The use of a pillow holding device is desirable in these situations.

Some devices have been developed over the years. While those may work for their intended purposes, none show the unique features of the present invention.

Thus, there exists a need for a pillow position maintainer that solves these and other problems.

SUMMARY OF THE INVENTION

A pillow position maintainer is provided. A harness is provided to affix to an object such as a chair or mattress. The harness has a loop and can have two adjustment straps. A hanger is provided with a shell and core. It also can have two fastener straps. The fastener strap(s) is removably connectable to the adjustment strap(s) and are connected to the shell. The position of the shell is adjustable with respect to the object via adjustment of the adjustment straps. The shell has a channel with a slot and a cavity. The channel is open to both ends of the shell. The inside of the cavity can have surfaces that are flat, such as a hexagon. The core is a compressible core. The core can be positioned inside a pillow case, and then be inserted into the cavity with the pillow case passing through the slot.

According to one advantage of the present invention, the pillow position maintainer holds the pillow in a selected position with respect to an object such as a chair back or mattress. This is advantageous as it prevents the pillow from sliding down the chair back or the raised end of a mattress.

According to another advantage of the present invention, the harness has a loop that is securable around a mattress or chair back. It is adjustable in length so as to be able to tighten in place around varying sized objects. The harness has a buckle for easy securing and removal.

According to a further advantage of the present invention, the hanger can have a shell with a cavity with a non-round interior and a round compressible core. The cavity can have flat sides, such as a polygon. In this regard, the core is easily compressible for insertion, and when expanded, can conform to the cavity shape. This effectively prevents the core from being rotatable within the shell under the force of normal use. This advantage become apparent during use with a pillow held in a pillow case. The pillow case will be pressed between the core and shell, whereby the hanger will tend to stay in place relative to the pillow case to prevent having the hanger move with respect to the pillow case (i.e., move about the case).

Expansion of the insert within the cavity also aids in limiting lateral shifting of the core within the cavity. This aids in maintaining balance of the hanger and full receipt of the core within the cavity.

According to another advantage of the present invention, the shell channel has a slot. The slot allows the pillow case to pass from the inside to the outside of the shell. Also, in an emergency situation or during times when a relatively large amount of force (for example, between 5 and 50 pounds) pulls the pillow away from the harness, the core can compress and pass through the slot thereby releasing the pillow or allowing it to break-away.

According to a further advantage of the present invention, the core can be inserted into the channel from either end.

According to a still further advantage of the present invention, the channel has tapered ends. This allows for easier insertion of the core into the channel, whereby the tapered end directs the end of the core to be aligned with the channel longitudinal axis.

According to a still further advantage yet of the present invention, the adjustment straps and fastener straps provide two points of engagement to support the pillow. This allows the pillow to be balanced.

According to a still further advantage yet of the present invention, the fastener straps can be removed from the adjustment straps of the harness so the pillow can be transported. The harness can remain in position when not in use. The pillow then can be moved between different locations, wherein a harness is in place at each location.

According to a further advantage of the present invention, two hangers can be used to support sides of a pillow (instead of the top). In this regard, the hangers can be positioned to the side of a user and can hold a pillow in an intended location, such as behind a user's back, without regard for the location of the shell in relation to the user position.

Other advantages, benefits, and features of the present invention will become apparent to those skilled in the art upon reading the detailed description of the invention and studying the drawings.

DETAILED DESCRIPTION OF PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

The present invention can be used with many objects, such as a chair 10 or mattress 30. It is appreciated that the present invention can be used with other objects without departing from the broad aspects of the present invention.

Figure 2:
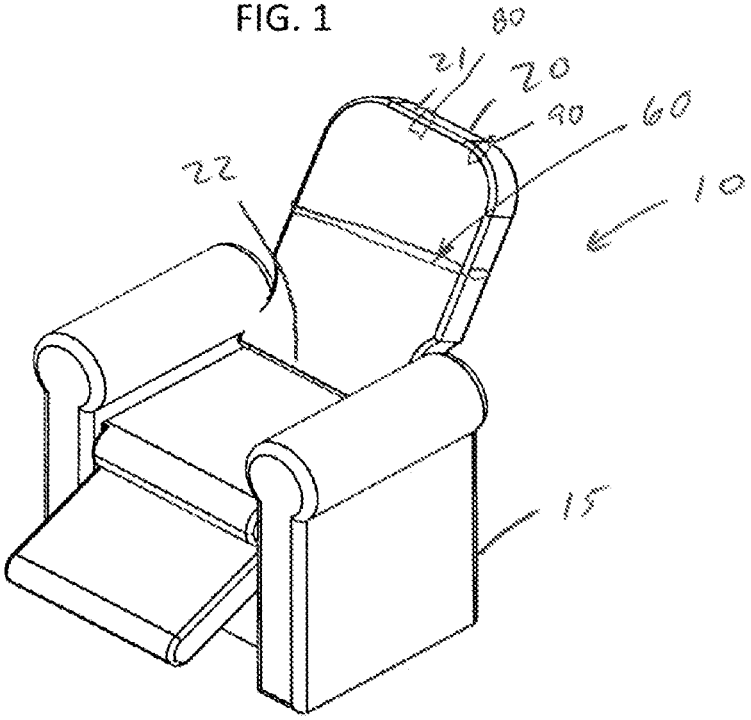
FIG. 2 is a perspective view of a chair.

Typically, a chair 10 has a base 15 and a back 20. The back 20 has a top 21 and a bottom 22. The chair can be a recliner style chair or other style chair. An exemplary view of a chair 10 is seen in FIG. 2.

Figure 3:
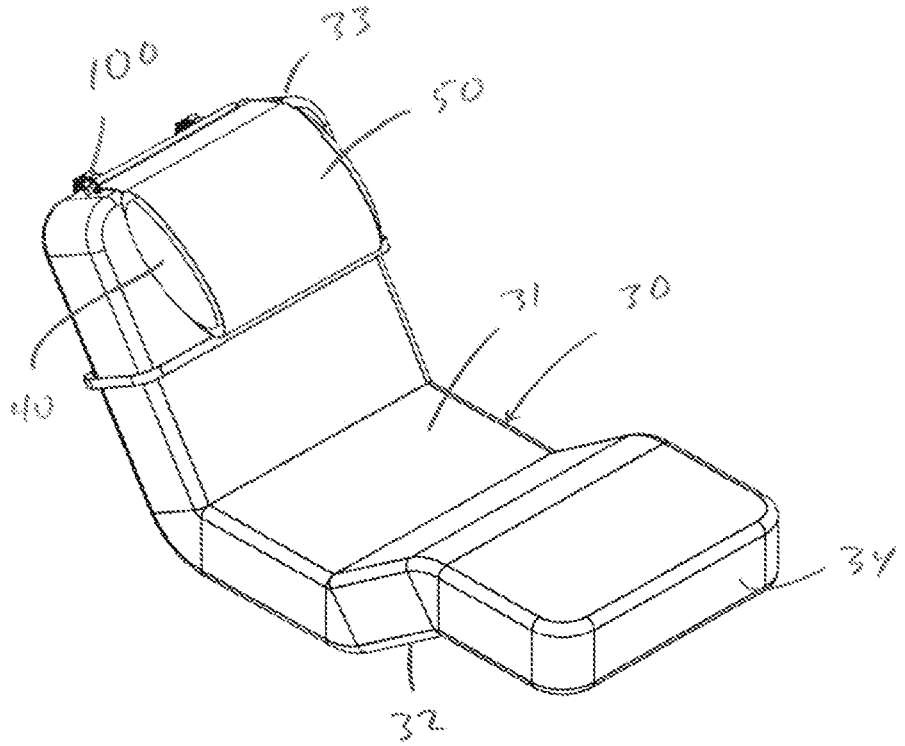
FIG. 3 is a is a perspective view of a mattress with a harness attached thereto.
Figure 4:
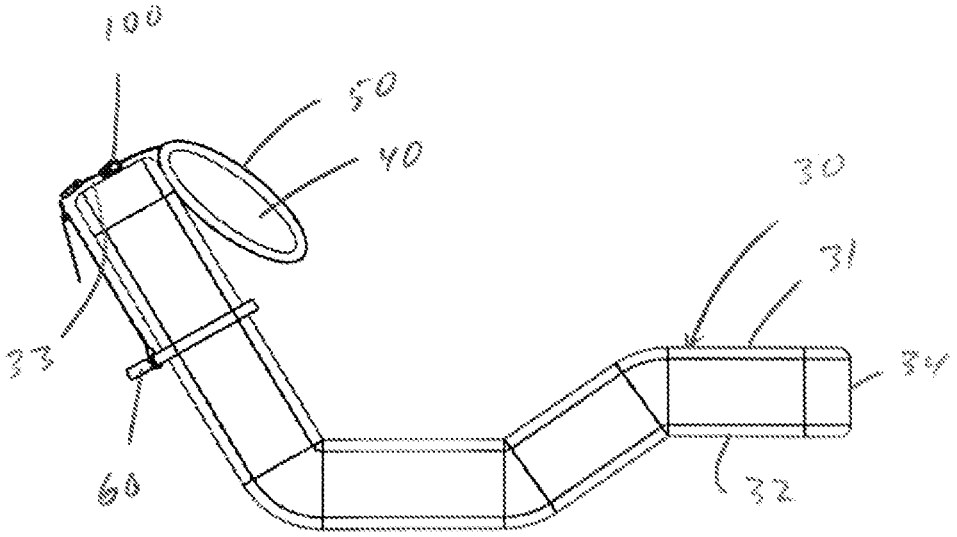
FIG. 4 is a side view of a mattress with a harness attached thereto.
Figure 5:
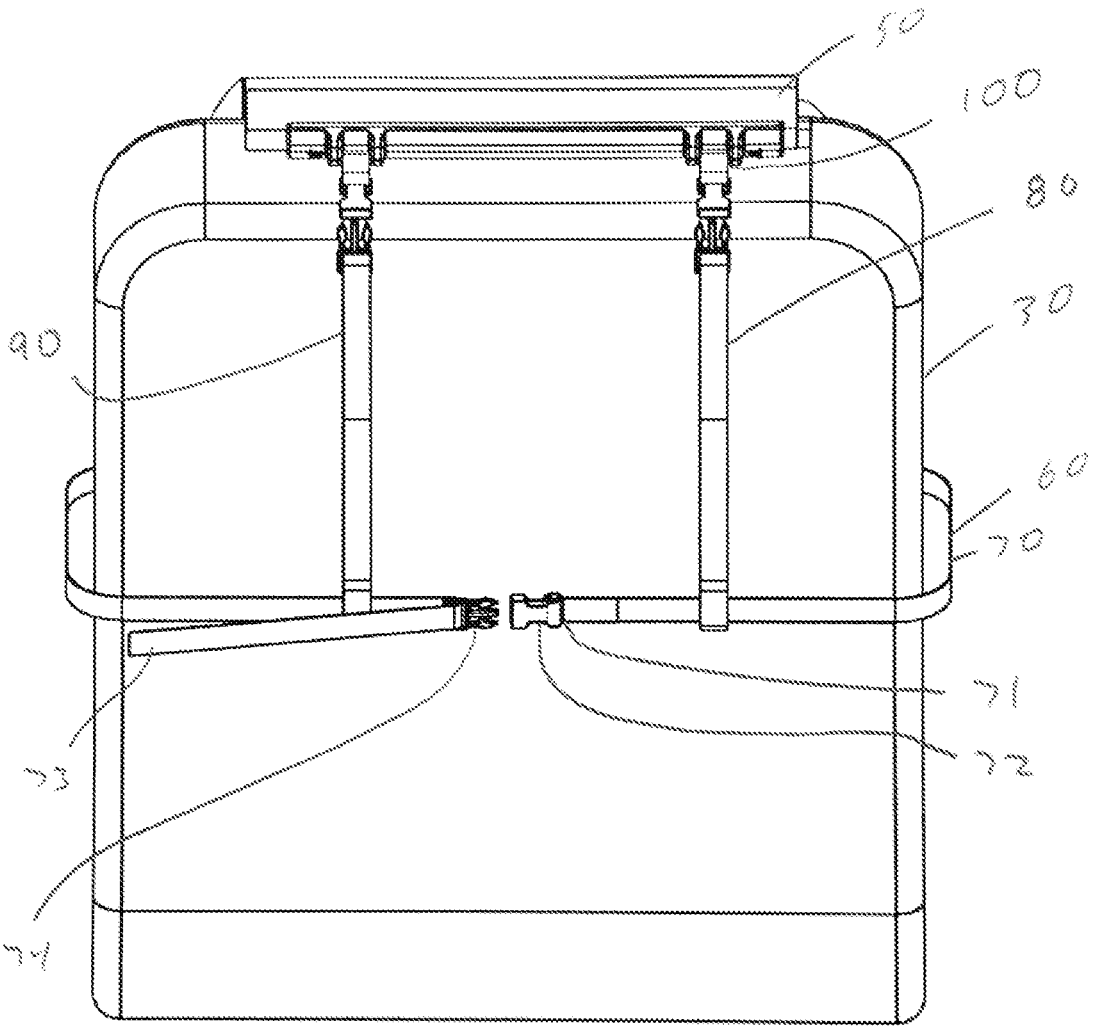
FIG. 5 is a rear view showing the buckle of the loop of the harness disengaged behind a mattress.
Figure 6:
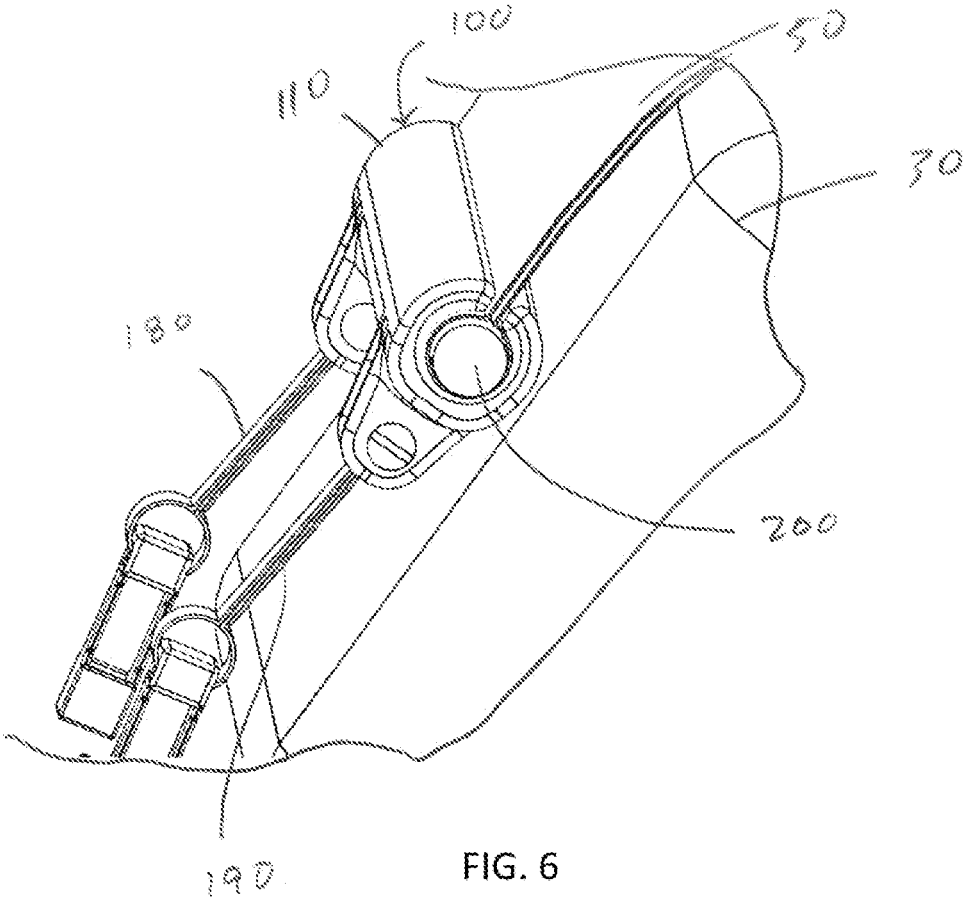
FIG. 6 is a perspective view showing an embodiment of the present invention in an intended environment.

The mattress 30 can have a top 31 and a bottom 32 and opposed ends 33 and 34, respectively. The mattress can be an articulating mattress wherein a bed frame articulates to selectably raise and lower the end 33 near the head, or head section, up and down. An exemplary view of a mattress 30 is shown in FIGS. 2-4.

Figure 7:
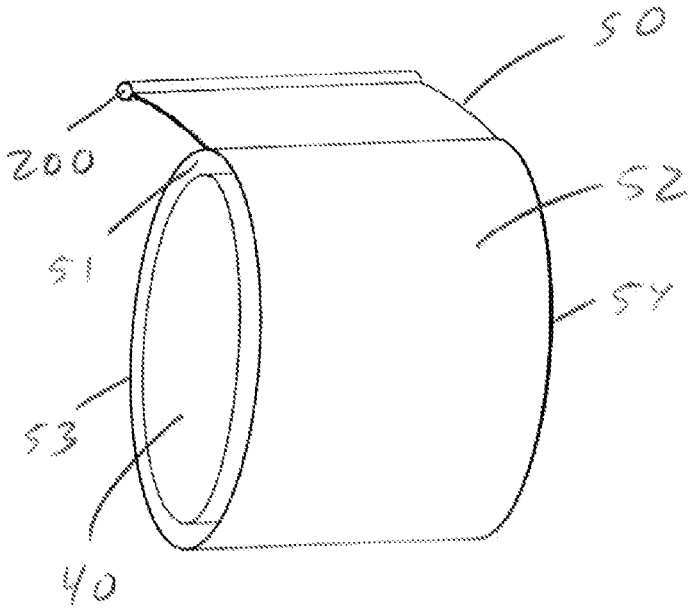
FIG. 7 is a perspective view of a pillow within a pillow case, with a core located on the inside of the pillow case.
Figure 8:
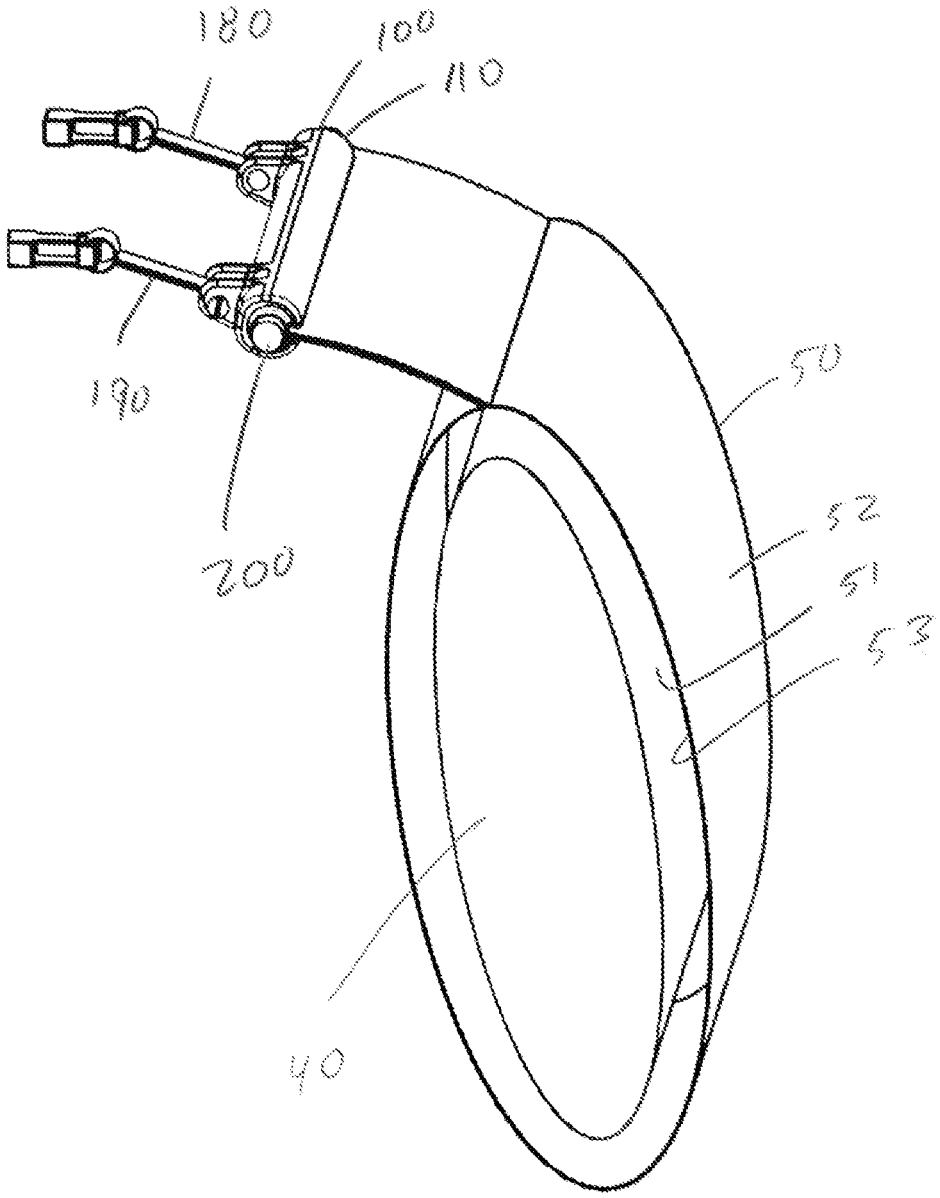
FIG. 8 is a perspective view of the hanger connected to the pillow case.

The invention is used to hold a pillow 40 in a pillow case 50 in an intended location with respect to the object. The pillow case 50 has an inside 51 and an outside 52, with an open end 53 and a closed end 54. Examples of a pillow 40 and pillow case 50 are illustrated in FIGS. 7 and 8.

The pillow position maintainer can have a harness 60 and a hanger 100.

Figure 1:
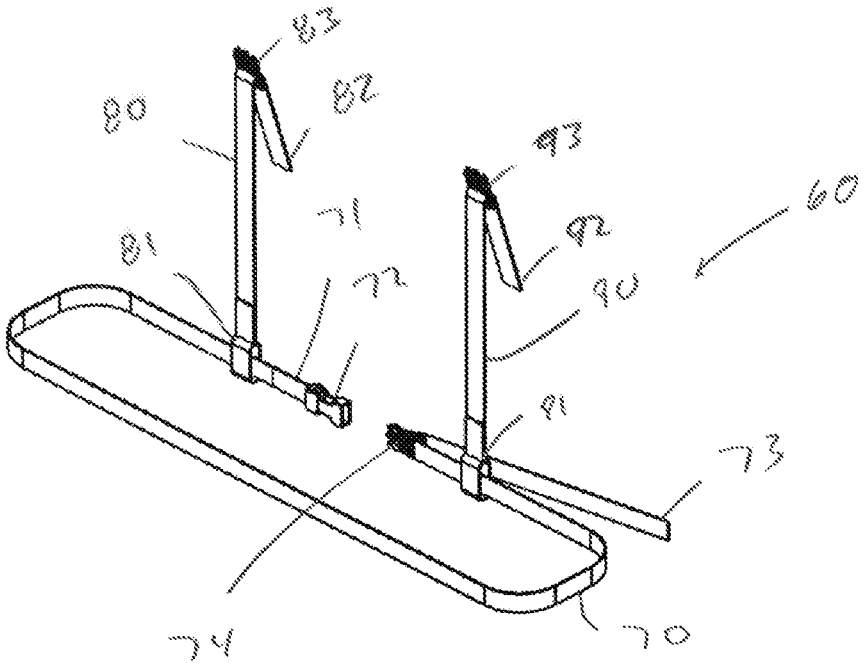
FIG. 1 is a perspective view of a harness.

A harness 60 can be provided. A view of a preferred embodiment of a harness 60 is illustrated in FIG. 1. The harness 60 has a loop 70 and two adjustment straps 80 and 90, respectively. Loop 70 has an end 71 with a buckle receiver 72 and an end 73. A buckle fastener 74 is movably connected to the loop 70 between ends 71 and 73. The buckle receiver 72 and buckle fastener 74 can be selectably engaged and disengaged. Adjustment strap 80 has ends 81 and 82. A buckle fastener 83 is movably connected to the adjustment strap 80 between ends 81 and 82. The adjustment strap end 81 is movably connected to the loop 70. Adjustment strap 90 has ends 91 and 92. A buckle fastener 93 is movably connected to the adjustment strap 90 between ends 91 and 92. The adjustment strap end 91 is movably connected to the loop 70.

The loop 70 can be wrapped around an object. The buckle receiver 72 and buckle fastener 74 can be engaged and the loop can be tightened onto the object by pulling upon end 73. The adjustment straps 80 and 90 can be moved to an intended location wherein the are approximately a selected distance apart on the backside of the object. The locations of the fasteners 83 and 93 can then be adjusted to selected positions resulting in desired effective lengths of the adjustment straps.

Figure 9:
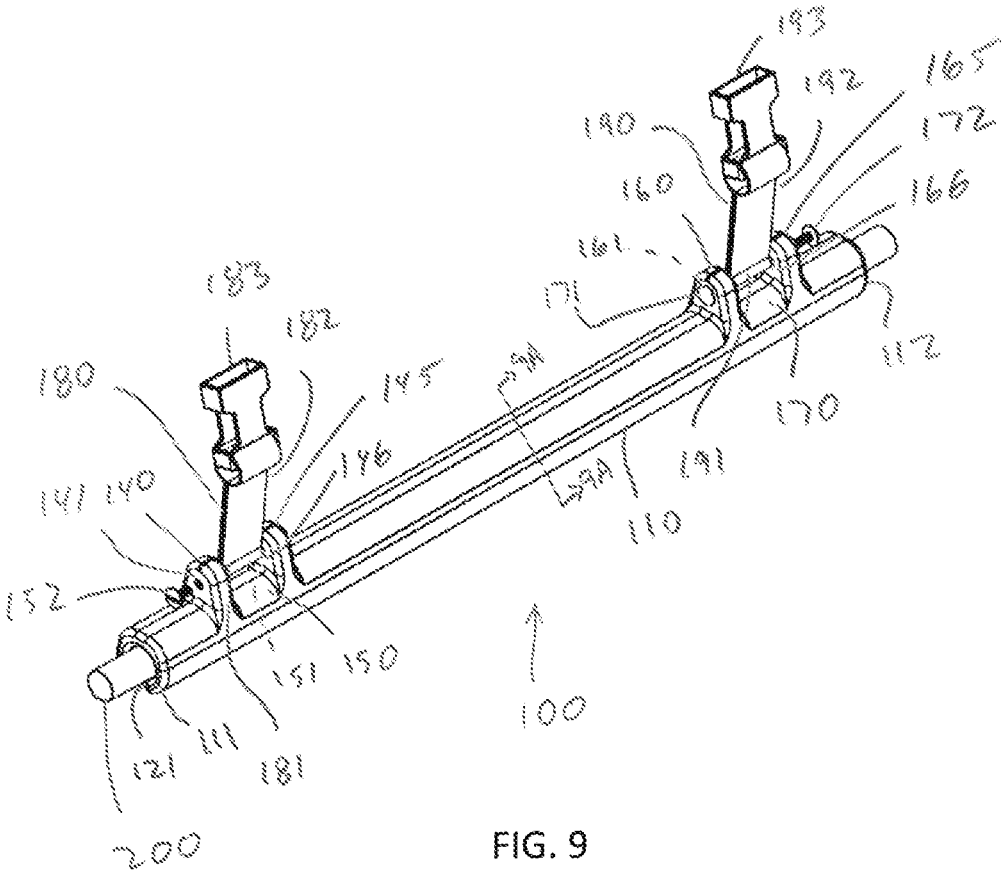
FIG. 9 is a perspective view of a preferred embodiment of a hanger of the present invention.
Figure 10:
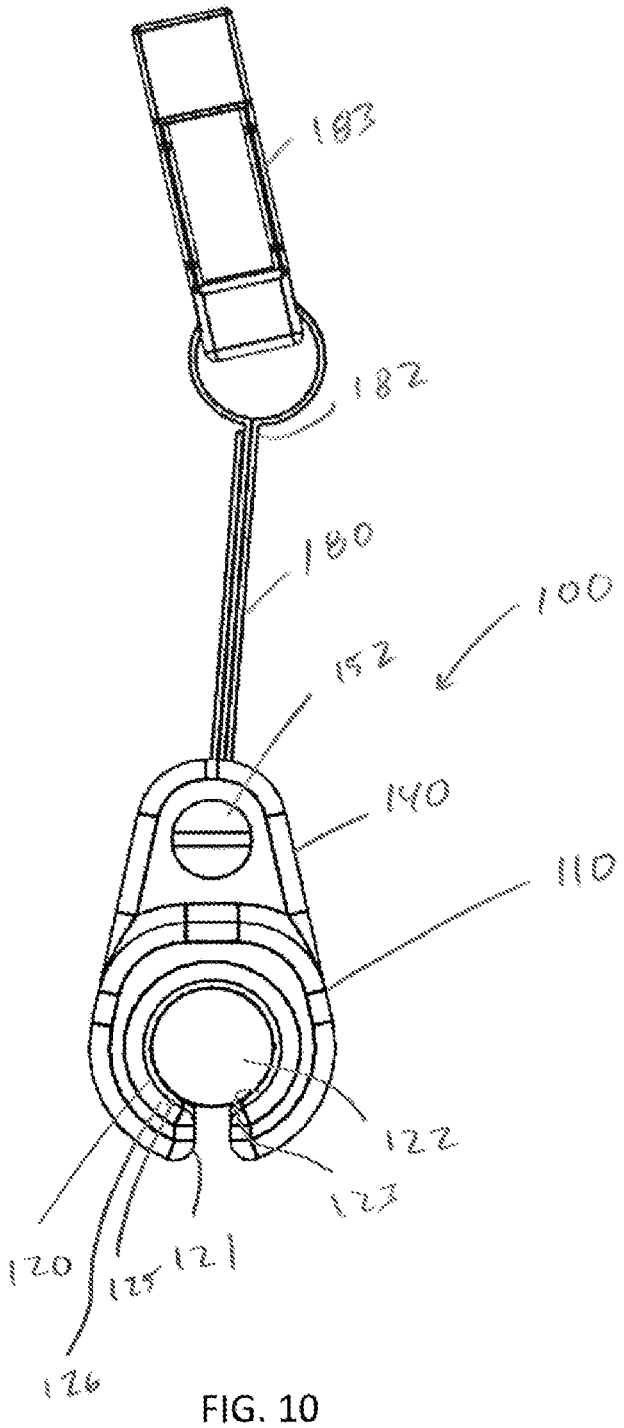
FIG. 10 is a side view of the embodiment illustrated in FIG. 9.
Figure 11:
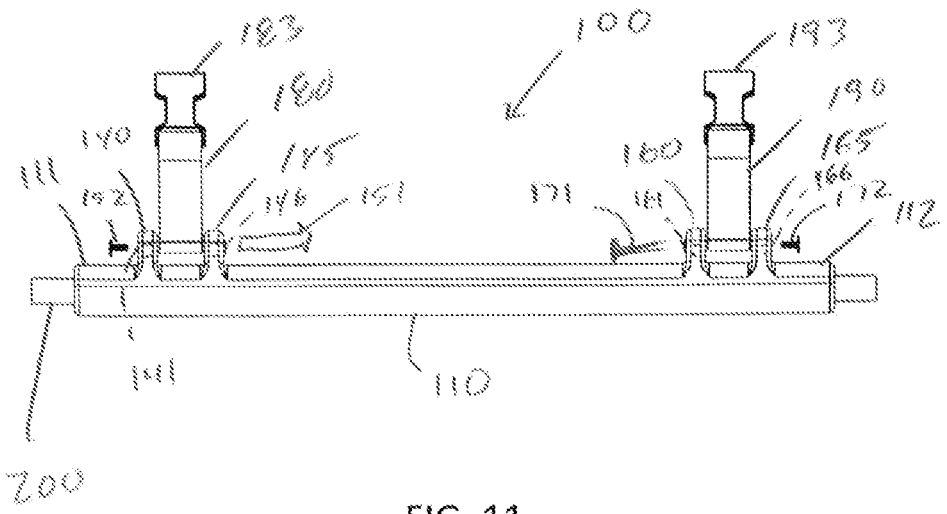
FIG. 11 is a rear view of the embodiment illustrated in FIG. 9.

A preferred embodiment of the hanger 100 of the present invention has a shell 110, fasteners traps 180 and 190, and a core 200. Each of these components will be described below. The hanger 100 is illustrated in FIGS. 9-11. The overall length and other dimensions can change from the illustrated embodiment without departing from the broad aspects of the present invention.

Figure 13:
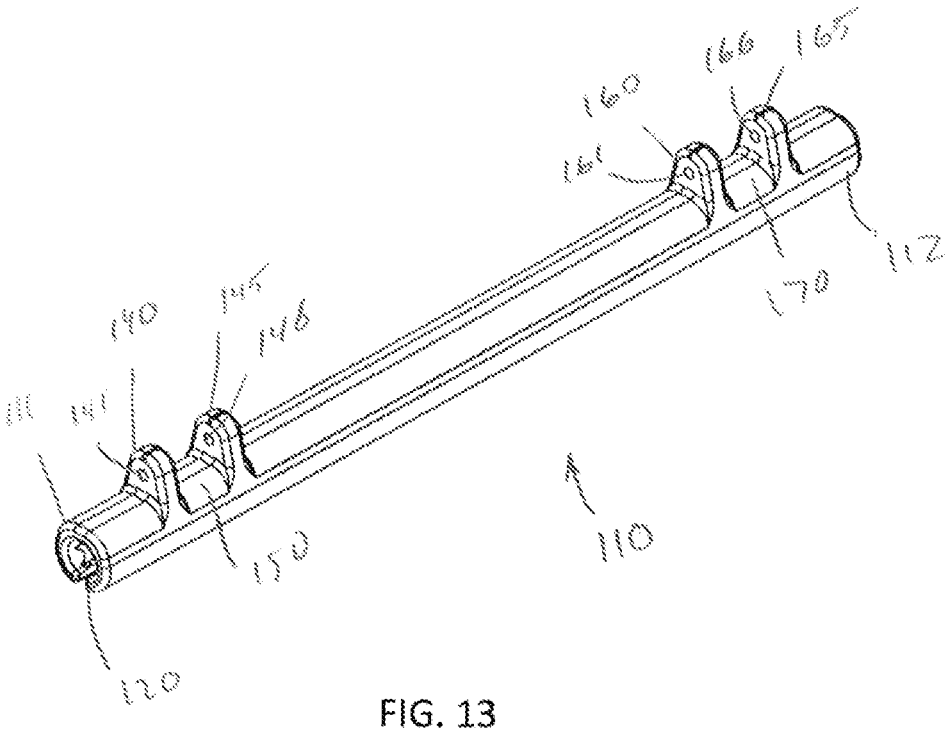
FIG. 13 is a perspective view of a preferred embodiment of a shell of the present invention.
Figure 14:
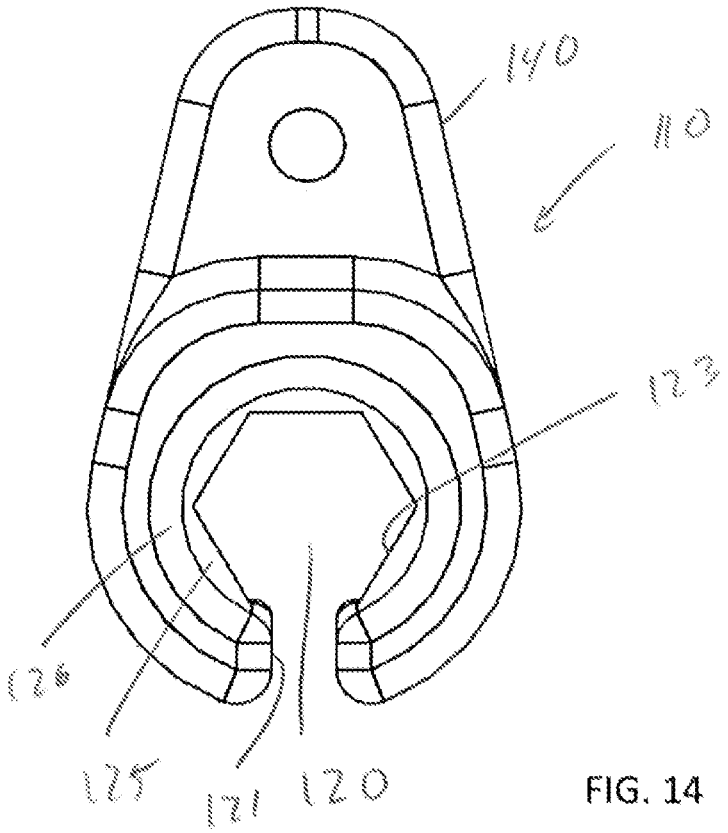
FIG. 14 is an end view of the shell illustrated in FIG. 13.
Figure 15:
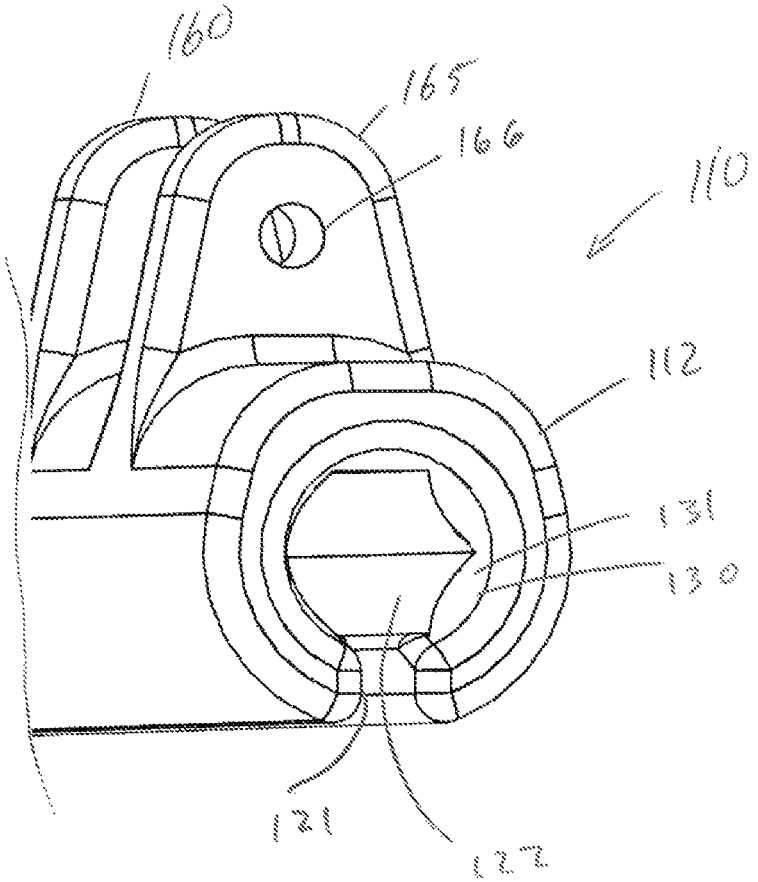
FIG. 15 is a perspective view of an end of the shell illustrated in FIG. 13.
Figure 16:
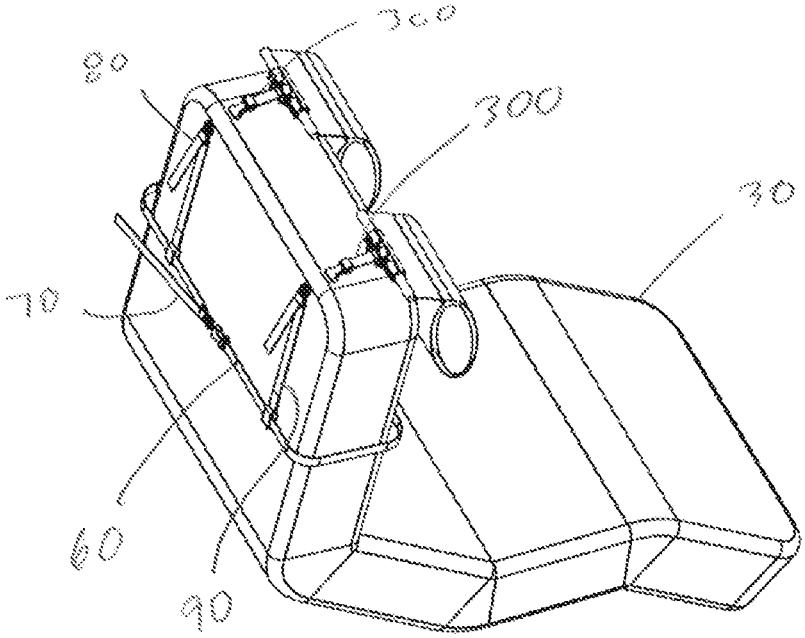
FIG. 16 is a perspective view showing two small pillows supported in selected positions.
Figure 17:
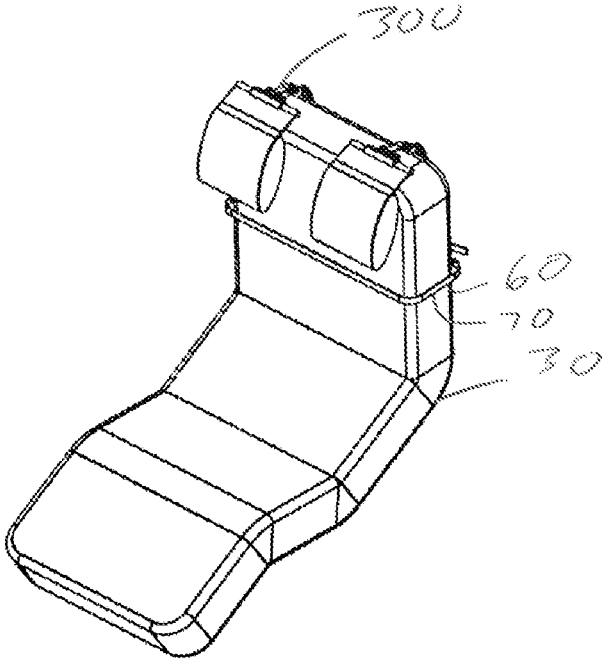
FIG. 17 is an alternative perspective view of the embodiment illustrated in FIG. 16.
Figure 18:
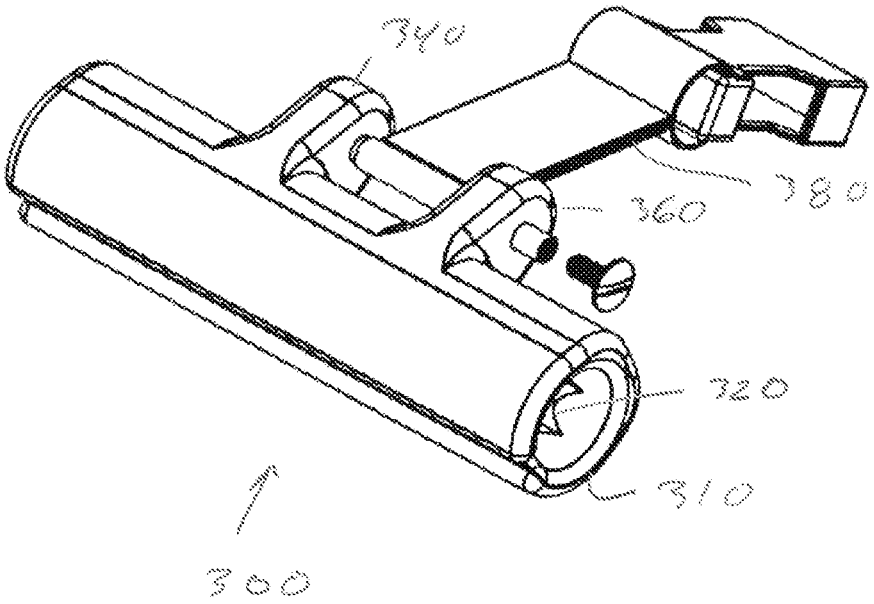
FIG. 18 is a perspective view of a hanger illustrated in FIG. 16.
Figure 19:
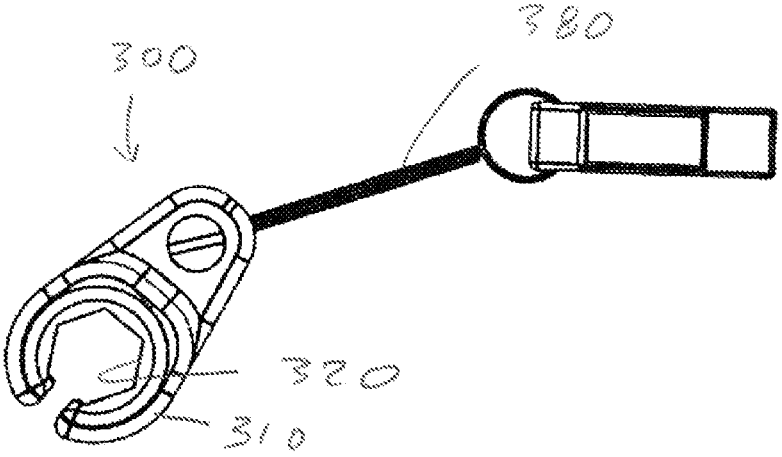
FIG. 19 is an end view of the hanger of FIG. 18.

The shell 110 is illustrated in isolation in FIGS. 13-15. The shell 110 has ends 111 and 112. A channel 120 having a slot 121 and a cavity 122 is formed through the shell 110 and spans between the ends 111 and 112. The cavity 122 has an interior dimension that can have flat surfaces 123. In this regard, the cavity is preferably non-round. It preferably has a hexagonal profile. Yet, it can have other shapes without departing from the broad aspects of the present invention. The slot 121 has a width, that is preferably a constant width, that is smaller than the cavity internal width dimension. The channel has an end 125 with a flare or taper 126, and an opposed end 130 also with a flare or taper 131. The shell 110 has ears 140, 145, 160 and 165 that are located opposite the slot 121. Ear 140 has hole 141 therethrough. Ear 145 has hole 145 therethrough. Ear 160 has hole 161 therethrough. Ear 165 has hole 166 therethrough. Ear 140 is separated from ear 145 with a gap 150. A post 151 and screw 152 can pass through holes 141 and 146. Ear 160 is separated from ear 165 with a gap 170. A post 171 and screw 172 can pass through holes 161 and 166. The shell is preferably made of a rigid material such as, but not limited to, plastic.

Fastener strap 180 has ends 181 and 182. A buckle receiver 183 is at end 182 of the fastener strap. End 181 can be connected to the post 151. Buckle receiver 183 can be selectably engaged and disengaged from buckle fastener 83.

Fastener strap 190 has ends 191 and 192. A buckle receiver 193 is at end 192 of the fastener strap. End 191 can be connected to the post 171. Buckle receiver 193 can be selectably engaged and disengaged from buckle fastener 93.

Figure 9A:
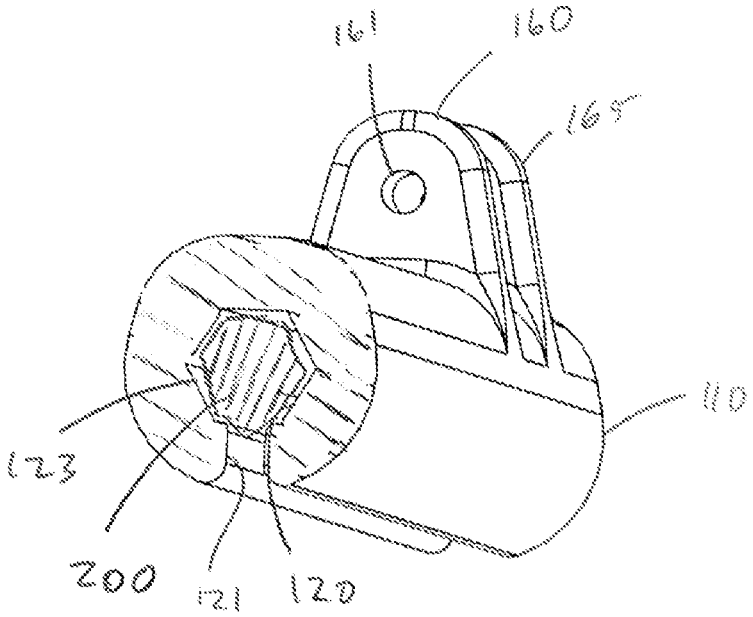
FIG. 9A is a cross-sectional view taken along line 9A-9A in FIG. 9.
Figure 12:
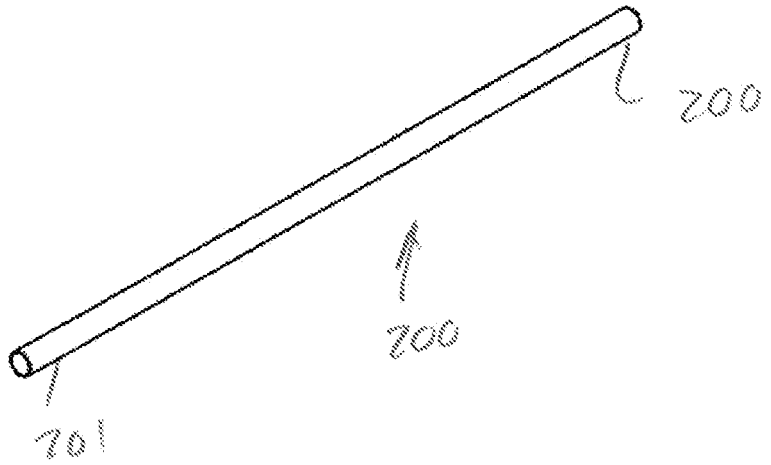
FIG. 12 is a perspective view of a preferred embodiment of a core of the present invention.

A preferred embodiment of a core 200 with ends 201 and 202 is illustrated in isolation in FIG. 12. The core 200 is preferably made of a compressible material such as, but not limited to, foam. The core 200 preferably has an undeformed exterior perimeter that is round. Turning to FIG. 9A, it is seen how the compressible insert conforms to the shape of the interior of the cavity when inserted into the channel 120 of the shell 110. FIG. 9 shows ends of the core 200 extending from the ends of the shell 110 having their undeformed external round shape. Extending the ends from the shell a short amount allows a user to grab the core 200 to pull it longitudinally out of either end of the cavity. Core 200 is shown in isolation in FIG. 12.

It is preferred that the width of the slot or slot 121 is sized in relation to the diameter, density and compressibility of the core 200 to achieve desired results. It is desired to have a core that remains within the channel 120 during normal operation but that is able to be removed from the channel 120 via the slot 121 during an emergency. In this regard, a highly compressible core could be paired with a narrow opening 121, and vice versa (a less compressible core could be paired with a wide opening). Stated another way, there is a combination of foam compressibility, slot width and core diameter (and possible other factors, such as friction) that results in the core being pulled from the cavity through the slot with a force of between 5 and 50 pounds. This force is the threshold force. It is appreciated that a different threshold force may be desired by the end user depending upon the intended situation for use or other factor. The minimum width of the opening 121 is two times the pillow case thickness. The opening size should be smaller than the width of the cavity immediately adjacent the opening.

Figure 20:
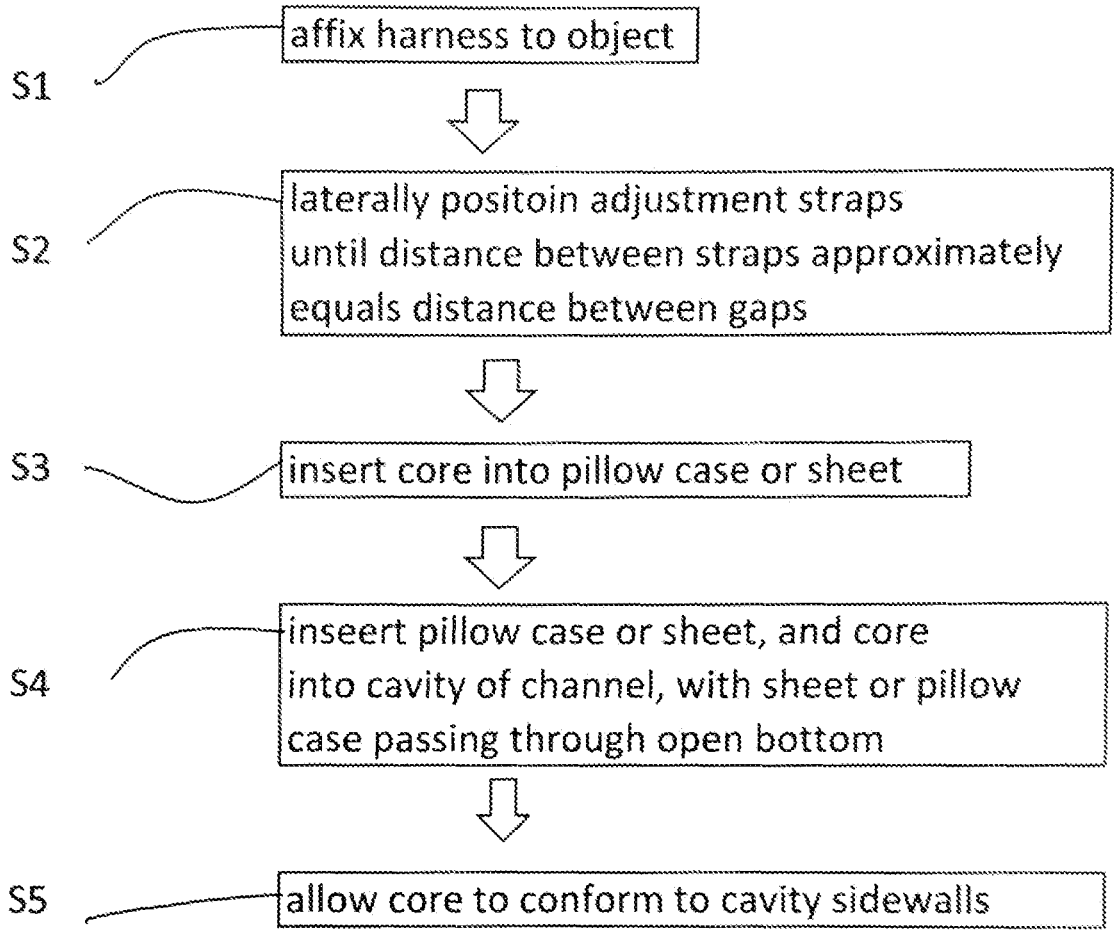
FIG. 20 is a flowchart showing use of an embodiment of the present invention.

Turning now more specifically to use of the present invention, the harness 60 is first affixed to or attached to the object (51, in FIG. 20). The adjustment straps 80 and 90 are then laterally positioned whereby they are spaced apart on the back of the object by a distance that is approximately equal to the distance between gaps 150 and 170 (S2).

The core 200 is then inserted into the open end 53 of the pillow case 50 and moved to the top of the pillow case adjacent the case whereby the pillow case 50 is wrapped around the core 200 (S3). The core 200 and pillow case 50 are then inserted into the shell 110, whereby the core 200 is received within the cavity 122 and the pillow case passes through the slot 121 of the channel 120 (S4). The core 200 conforms to the shape of the cavity 122 as it partially decompresses (S5).

The fastener straps 180 and 190 are aligned with and fastened with adjustment straps 80 and 90, respectfully. The adjustment straps 80 and 90 can be adjusted so that the pillow is at a desired position on the object.

It is appreciated that there can be more or fewer ears on the shell without departing from the broad aspects of the preset invention to accommodate a desired number of fastener straps. It is appreciated that there could be a desire for a single engagement between the shell and harness, or more than two engagements without departing from the broad aspects of the present invention.

Turning now to FIGS. 16-19, it is seen that an alternative preferred embodiment of a hanger 300 is illustrated. The hanger 300 has a shell 310 with a channel 320 and two ears 340 and 360, respectively. A fastener strap 380 is also provided. The hanger 300 is about ¼ as long as hanger 100, but could be larger or smaller in proportion to hanger 100 without departing from the broad aspects of the present invention. Hanger 300 can be used with small pillows. Two hangers 300 (for two small pillows as illustrated, or one large pillow) can be used with a mattress. Operation of hanger 300 is similar to operation of hanger 100, as it is preferably used with a compressible core. It is appreciated that a single strap and hanger 300 could be used in situations where only one small pillow is desired.

Figure 21:
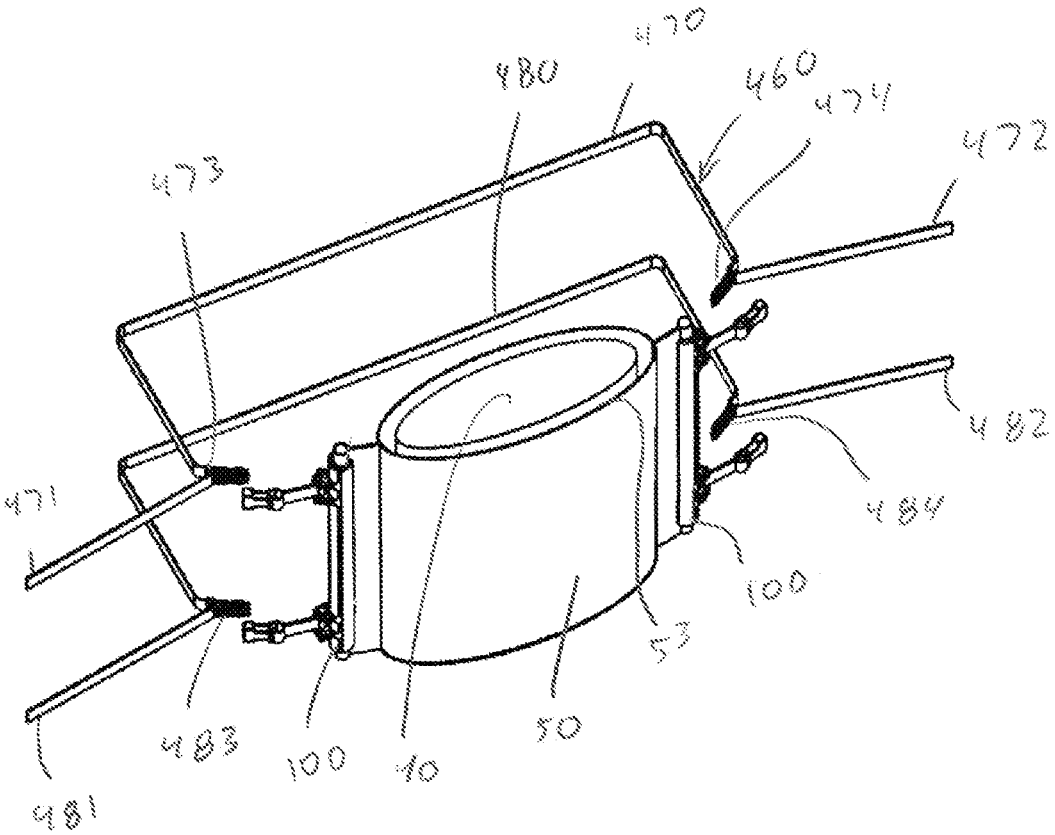
FIG. 21 is a perspective view showing a harness adapted to support a pillow from the sides along with a pillow case connected to two hangers.
Figure 22:
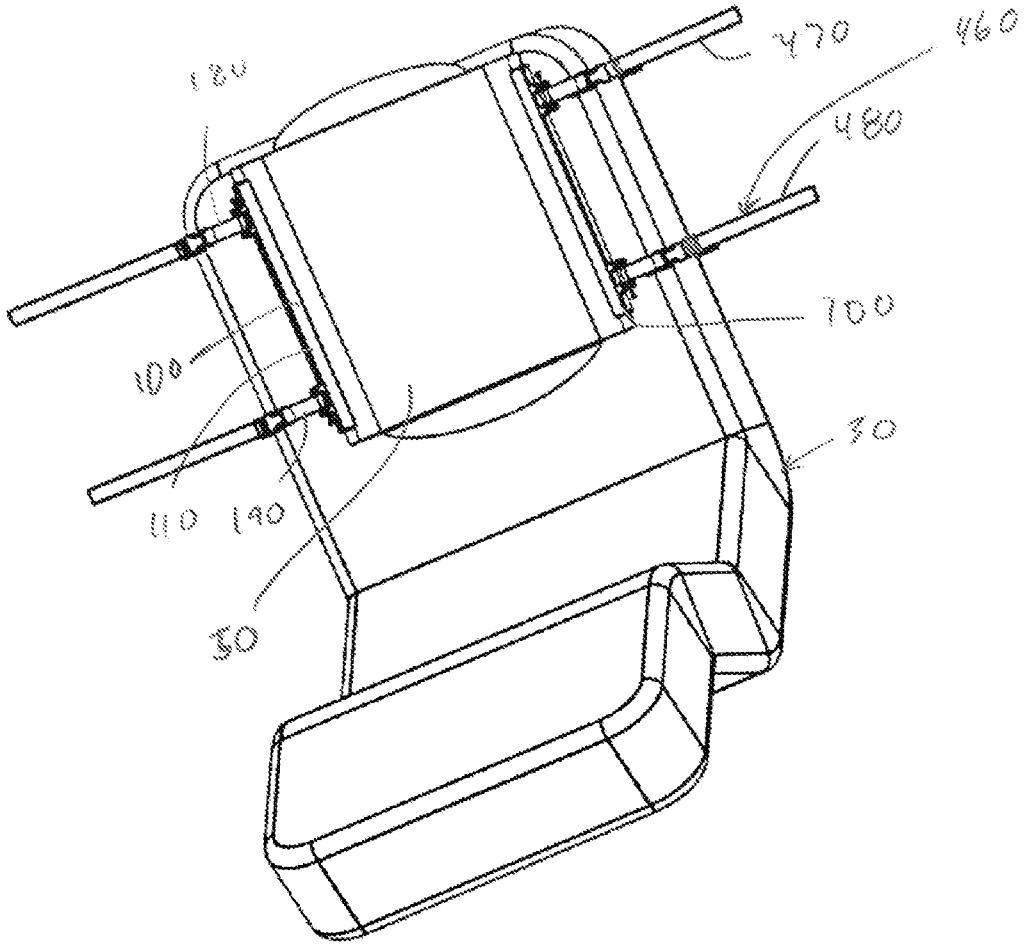
FIG. 22 is a perspective view showing a pillow supported from the sides in relation to an object.

Turning now to FIGS. 21 and 22, it is seen how two hangers 100 can be used to hold a pillow 40 vertically on the back of an object, such as a mattress 30. A harness 460 with two straps 470 and 480, respectively, are provided. Strap 470 has ends 471 and 472. Two buckle fasteners 473 and 474 are movably connected to the strap 470 between the ends. Strap 480 has ends 481 and 482. Two buckle fasteners 483 and 484 are movably connected to the strap 470 between the ends. Buckle fasteners 473 and 483 can connect to a first hanger, and buckle fasteners 474 and 484 can connect to a second hanger. Each hanger 100 is used to connect to the side of the pillow case 50 to support the pillow 40 in position on the object, such as a mattress 30.

It is appreciated that, similar to what is shown in FIG. 21, that two hangers could be used with single fastener straps to secure a small pillow on both sides of the pillow.

Figure 23:
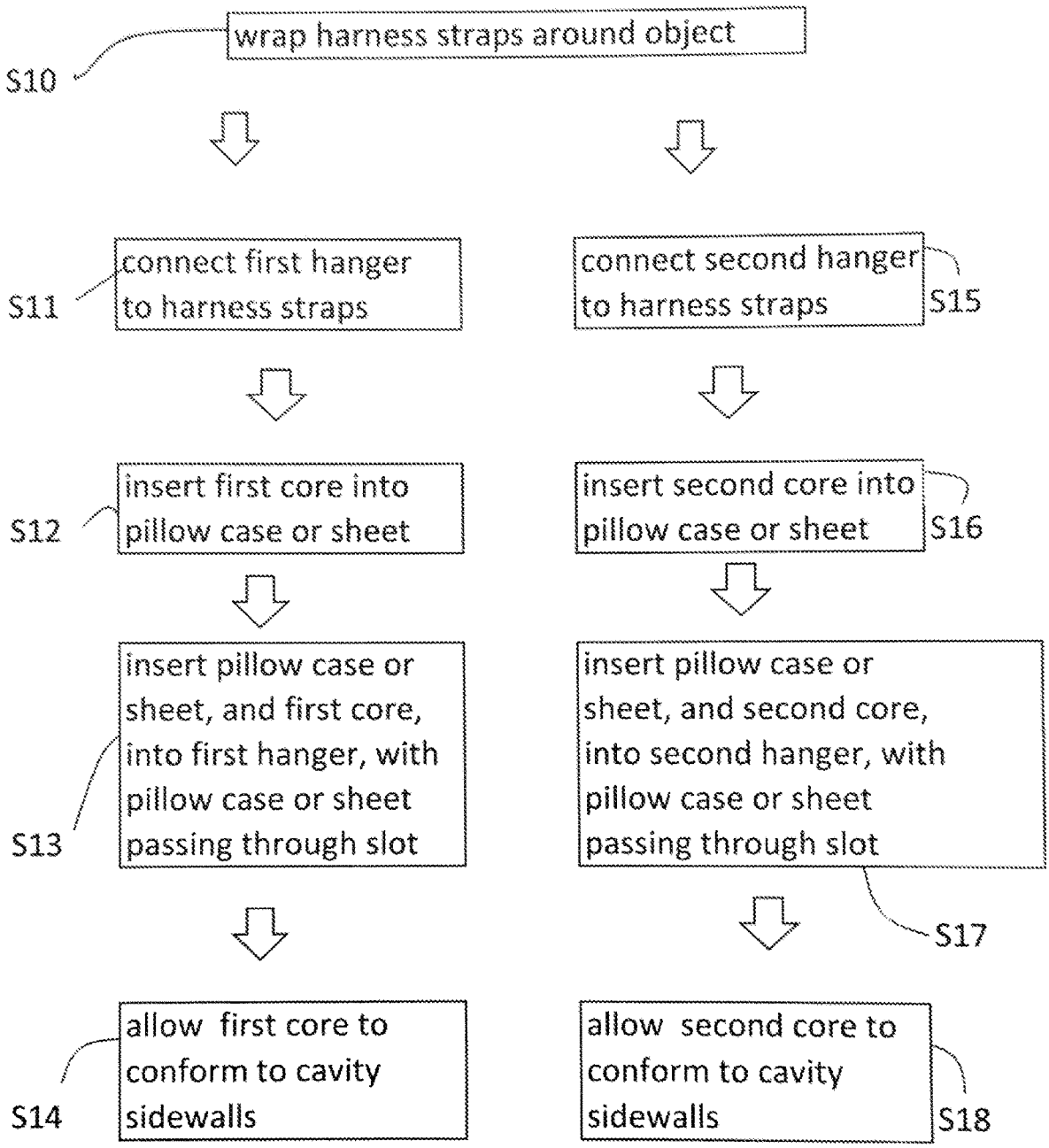
FIG. 23 is a flowchart showing use of an embodiment of the present invention.

In use (FIG. 23), the harness straps 470 and 480 are wrapped around the object (S10). Then, then first hanger is connected to the harness straps (S11) and the second hanger is connected to the harness straps (S15). The first core is inserted into the pillow case or sheet (S12), the pillow case or sheet, and the first core, are then inserted into the first hanger with the pillow case or sheet passing through the slot (S13) and the first core expands to conform to the cavity sidewalls (S14). The second core is inserted into the pillow case or sheet (S16), the pillow case or sheet, and the second core, are then inserted into the second hanger with the pillow case or sheet passing through the slot (S17) and the second core expands to conform to the cavity sidewalls (S18).

Figure 24:
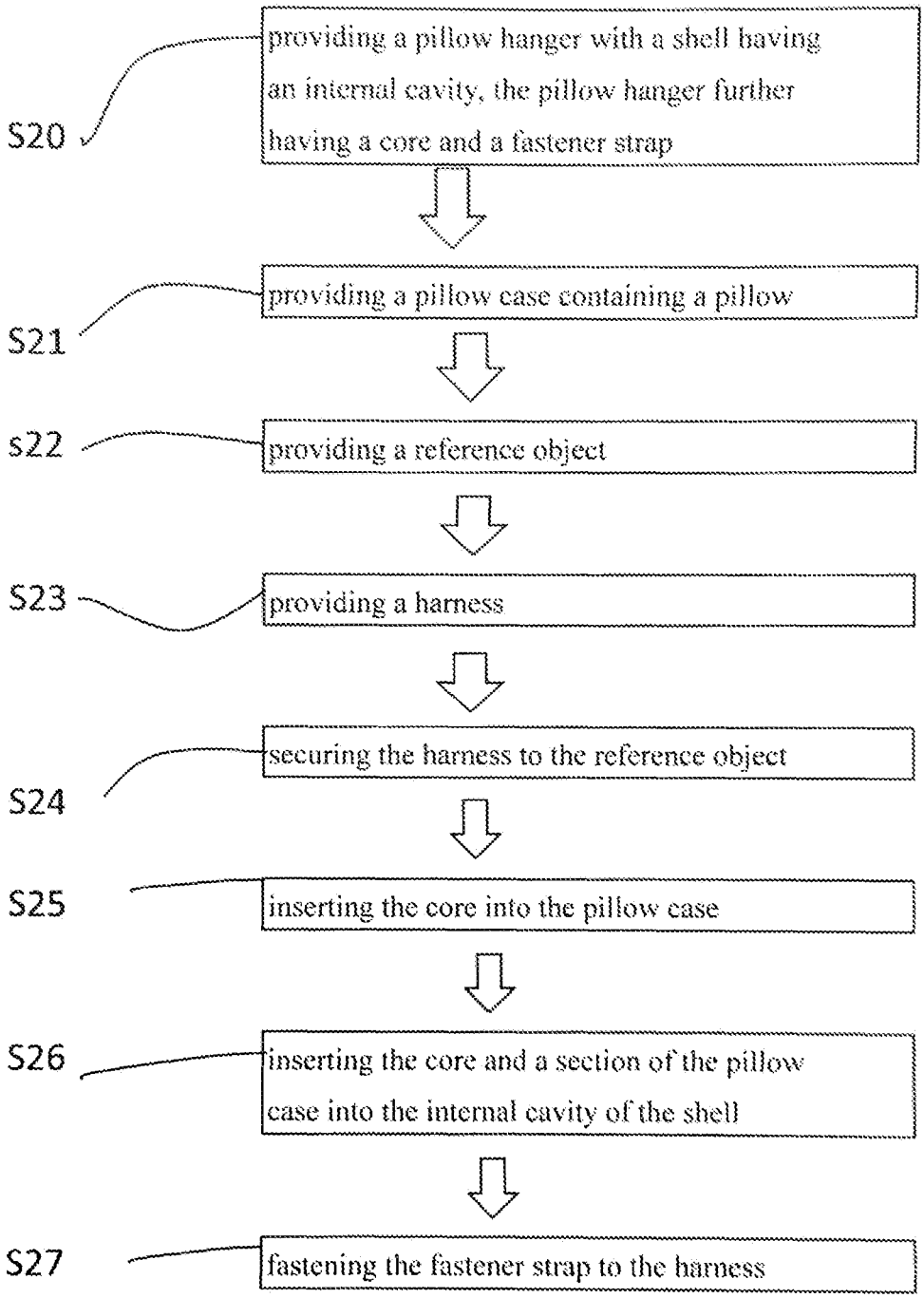
FIG. 24 is a flowchart showing a preferred method of using a pillow hanger.

Turning now to FIG. 24, a chart showing a method of using the present invention is illustrated.

Step S20 is providing a hanger with a shell having an internal cavity, the hanger further having a core and a fastener strap. Step S21 is providing a pillow case containing a pillow. Step S22 is providing a reference object. The reference object could be a bed, chair, couch, table or other object that the hanger can be secured to. Step S23 is providing a harness. Step S24 is securing the harness to the reference object. Step S25 is inserting the core into the pillow case. Step S26 is inserting the core and a section of the pillow case into the cavity of the shell. Step S27 is fastening the fastener strap to the harness.

These steps can be expanded upon in a number of ways, and other steps can be added without departing from the broad aspects of the present invention. For example, the step of providing a harness can include providing a loop and an adjustment strap, wherein adjustment of length of the adjustment strap determines a location of the shell relative to the reference object. Further, the step of providing a pillow hanger can further comprise the step of providing a second fastener strap and the step of providing a harness further includes the step of providing a second adjustment strap. Still further, the step of providing a pillow hanger can further comprise the step of providing the internal cavity that has a shape that is non-round. Still further, the step of inserting the core and a section of the pillow case into the internal cavity of the shell can further comprise the step of having the core conform to the shape of the internal cavity. Still further yet, the step of providing a pillow hanger can further comprise the step of providing a slot between a first cavity flared end and a second cavity flared end.

Thus, it is apparent that there has been provided, in accordance with the invention, a pillow position maintainer that fully satisfies the objects, aims, and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

The invention claimed is:

1. A system configured to maintain a position of a pillow with respect to an object, said system comprising:
a pillow hanger comprising:
a shell with a cavity having a shape;
a core; and
a fastener strap connected to the shell;
wherein said core is a deformable core that is received within said cavity and conforms to said shape of said cavity; and
a pillowcase having a pocket or opening configured to receive said core and said pillow therein.

2. The system of claim 1, wherein said shape is non-round.

3. The system of claim 2, wherein said shape is polygonal.

4. The system of claim 2, wherein: said core has an external profile that is round in a non-compressed condition; and said core conforms to said shape of said cavity, wherein rotation of said core relative to said cavity is prevented.

5. The system of claim 1, wherein said shell has a first end and a second end and has a slot through said shell between said first end and said second end.

6. The system of claim 5, wherein: said cavity has a cavity first end that is a flared first end; said cavity has a cavity second end that a flared second end; and said core is insertable into said cavity from either of said cavity first end and said cavity second end.

7. The system of claim 1, wherein: said pillow hanger is connectable to a harness, said harness having a loop and an adjustment strap; said shell has an ear; a fastener strap is connected to said ear; and said adjustment strap is removably connected to said fastener strap.

8. The system of claim 7, wherein: said harness has a second adjustment strap; said shell has a second ear; a second fastener strap is connected to said second ear; and said second adjustment strap is removably connected to said second fastener strap.

9. The system of claim 1, wherein said core is removably from said cavity through a slot when a threshold force is applied to said core in a direction perpendicular to a longitudinal axis of said cavity.

10. A system configured to maintain a position of a pillow with respect to an object, said system comprising:
a pillow hanger comprising:
a shell with a cavity and a slot; and
a core;
wherein said core is deformable; wherein said core is held within said cavity during regular pillow hanger operation but is removable through said slot when a threshold force is applied to said core in a direction perpendicular to a longitudinal axis of said cavity; and
a pillowcase having a pocket or opening configured to receive said core and said pillow therein.

11. The system of claim 10, wherein: said cavity is non-round; said core has an external profile that is round in a non-compressed condition; and said core conforms to a shape of said cavity, wherein rotation of said core relative to said cavity is prevented.

12. The system of claim 10, wherein: said cavity has a cavity first end that is a flared first end; said cavity has a cavity second end that a flared second end; said core is insertable into said cavity from either of said cavity first end and said cavity second end; and said slot extends between said cavity first end and said cavity second end.

13. The system of claim 10 further comprising a fastener strap connected to said shell.

14. The system of claim 13, wherein: said pillow hanger is removably connectable to a harness, said harness having a loop and an adjustment strap; and said adjustment strap is removably connected to said fastener strap.

15. A method of using a pillow hanger, the method comprises the steps: providing a pillow hanger with a shell having an internal cavity, the hanger further having a core and a fastener strap; providing a pillow case containing a pillow; providing a reference object; providing a harness; securing the harness to the reference object; inserting the core into the pillow case; inserting the core and a section of the pillow case into the cavity of the shell; and fastening the fastener strap to the harness.

16. The method of using a pillow hanger of claim 15, wherein the step of providing a harness includes providing a loop and an adjustment strap, wherein adjustment of length of the adjustment strap determines a location of the shell relative to the reference object.

17. The method of using a pillow hanger of claim 16, wherein: the step of providing a pillow hanger further comprises the step of providing a second fastener strap; and the step of providing a harness further includes the step of providing a second adjustment strap.

18. The method of using a pillow hanger of claim 15, wherein the step of providing a pillow hanger further comprises providing the internal cavity that has a shape that is non-round.

19. The method of using a pillow hanger of claim 18, wherein the step of inserting the core and a section of the pillow case into the internal cavity of the shell further comprises the step of having the core conform to the shape of the internal cavity.

20. The method of using a pillow hanger of claim 15 the step of providing a pillow hanger further comprises the step of providing a slot between a first cavity flared end and a second cavity flared end.

* * * * *